US007900292B1

(12) United States Patent
Ashby, Jr.

(10) Patent No.: US 7,900,292 B1
(45) Date of Patent: Mar. 8, 2011

(54) INDIVIDUAL ASSISTING DEVICE FOR BATHTUBS

(76) Inventor: Edward Peyre Ashby, Jr., Fairbanks, AK (US)

( * ) Notice: Subject to any disclaimer, the term of this patent is extended or adjusted under 35 U.S.C. 154(b) by 0 days.

(21) Appl. No.: 12/798,942

(22) Filed: Apr. 13, 2010

(51) Int. Cl.
*A47K 3/02* (2006.01)

(52) U.S. Cl. ..... 4/566.1; 5/81.1 R; 254/2 C; 254/134

(58) Field of Classification Search ..... 4/560.1–566.1; 5/81.1 R, 611; 254/2 C, 83 HP, 93 R, 122, 254/124, 126, 134
See application file for complete search history.

(56) References Cited

U.S. PATENT DOCUMENTS

| | | | | | |
|---|---|---|---|---|---|
| 2,968,814 | A | * | 1/1961 | Ashby, Jr. | 4/564.1 |
| 3,400,410 | A | * | 9/1968 | Sallinger | 4/564.1 |
| 3,797,676 | A | * | 3/1974 | McCarthy | 414/592 |
| 3,958,282 | A | * | 5/1976 | Crowe | 4/566.1 |
| 4,091,478 | A | * | 5/1978 | Hardwick et al. | 4/562.1 |
| 4,984,774 | A | * | 1/1991 | Zupancic et al. | 5/601 |
| 5,007,121 | A | * | 4/1991 | McEathron | 4/566.1 |
| 5,068,390 | A | * | 11/1991 | Kuhn et al. | 558/461 |
| 5,377,366 | A | * | 1/1995 | Boyd et al. | 4/561.1 |
| 5,423,096 | A | * | 6/1995 | Janisch | 4/566.1 |
| 5,555,575 | A | * | 9/1996 | Anscombe-Black et al. | 4/563.1 |
| 5,579,544 | A | * | 12/1996 | Attler | 4/566.1 |
| 5,937,454 | A | * | 8/1999 | Drew | 4/565.1 |
| 6,415,459 | B1 | * | 7/2002 | Sevier | 4/566.1 |
| 6,425,146 | B1 | * | 7/2002 | O'Brien et al. | 4/560.1 |
| 7,506,385 | B2 | * | 3/2009 | Werschmidt | 4/561.1 |

* cited by examiner

*Primary Examiner* — Charles Phillips

(57) ABSTRACT

In summary, this device offers many unique features advantageous to the user.

This device will be economical to buy and is light and easy for one person to handle. This device is simple and easy to be placed in a standard bathtub and is convenient and easy to operate by the user or an assistant, This device will be comfortable and relaxing as it supports the entire body of the user. This device is convenient and easy to keep in a sanitary condition and easy to remove from the bathtub as desired.

The innovations I have made to Ashby's device of 1961 U.S. Pat. No. 2,968,814 renders it feasible to manufacture and market. The fact that it was in public Domain these many years and has not been taken seems to be an indication that it wasn't deemed a feasible item. My innovation of stabilizing platform 20 and being able to eliminate the awkward, vertical, inverted U shaped frame and sides and attachments thereto has made this device simple and economical to produce and market. My innovations have made this device easier to handle and use and much more desirable as an assisting device. There are a number of devices on the market to lower and elevate an individual in the bathtub but none with the features of this device.

I have a working prototype of this device which I left with a prospective manufacturer who is awaiting my filing this application.

3 Claims, 3 Drawing Sheets

20
33A
34A
36
32A
10
TuB 47
46
45
53
60
36
20
36
55
24
44
33A
33B
34A
34B
41
32A
32B
12
43
42
62
62
11
10
68
14

INDIVIDUAL ASSISTING DEVICE FOR BATHTUBS

DESCRIPTION AND OBJECTIVES OF THIS DEVICE

This description relates to a device for assisting an individual get into and out of a bathtub.

A primary object of the device is to provide a simplified relatively lightweight unit for safely and easily lowering and elevating an individual in a bathtub.

A further object of the device is to provide helpful means of the above-mentioned character adapted to be placed bodily within any standard bathtub, and used in conjunction with the bathtub for lowering and elevating the person in the desired manner.

Another object is to provide an individual assisting device for bathtubs, the use of which device requires no structural alterations of the bathtub or attachment of fixtures thereto.

A further important object is to provide individual assisting means of the above-mentioned character which may be readily operated by the user, a single attendant or nurse with a minimum of physical effort.

Still another object is to provide individual assisting means of the above-mentioned character which is rugged and durable in construction, economical to manufacture, reliable in operation and easy to maintain in a sanitary condition.

A further object is to provide a device of the above-mentioned character which does not employ electrical or power operated equipment in conjunction therewith, thereby greatly reducing hazards attendant to the use of such devices in water.

Another object of the device is to provide an individual assisting unit for bathtubs having manual operating means which remain above the water level in the bathtub at all times, so that the user or attendant need not' extend his or her hand or arm into the water while lowering or elevating the platform 20.

A most important object of this device is to support the entire body of the user including the head and the feet during the use of this device. Other objects and advantages of this device will become apparent during the course of the following description.

DRAWINGS OF THIS DEVICE

In the accompanying drawings forming a part of this application, like numerals are employed to designate like parts throughout the same, FIG. 1 is a perspective view of this individual assisting device for bathtubs according to the descriptions.

DESCRIPTION OF COMPONENTS OF THIS DEVICE

Figure 1:
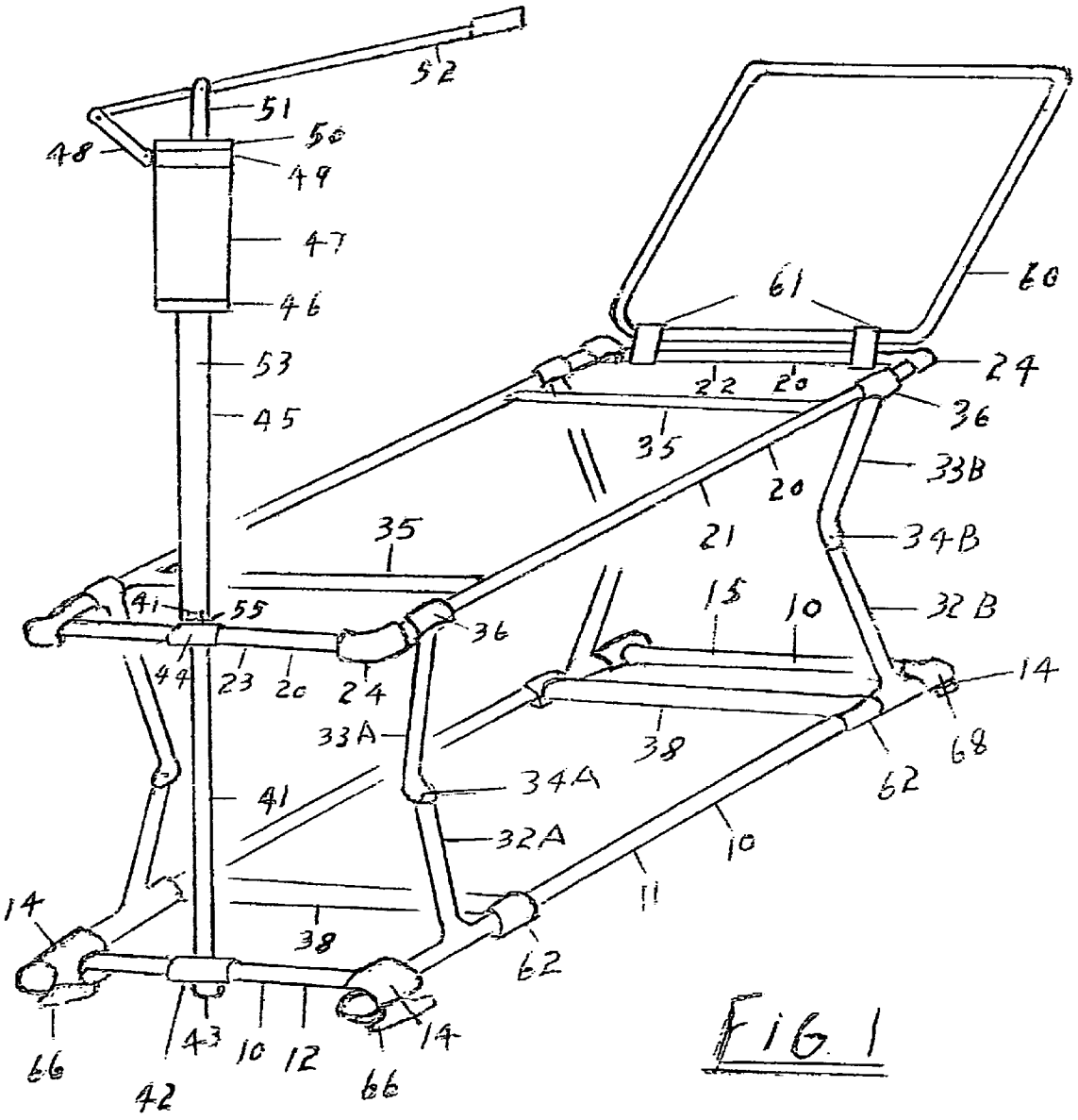
Figure 3:
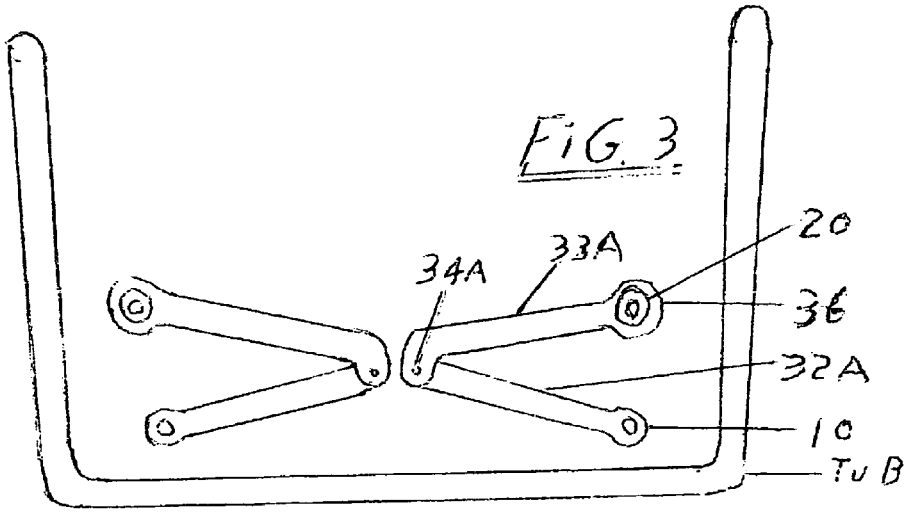
FIG. 3 is an end view of the device with parts positioned for elevating the lifting platform 20.
Figure 2:
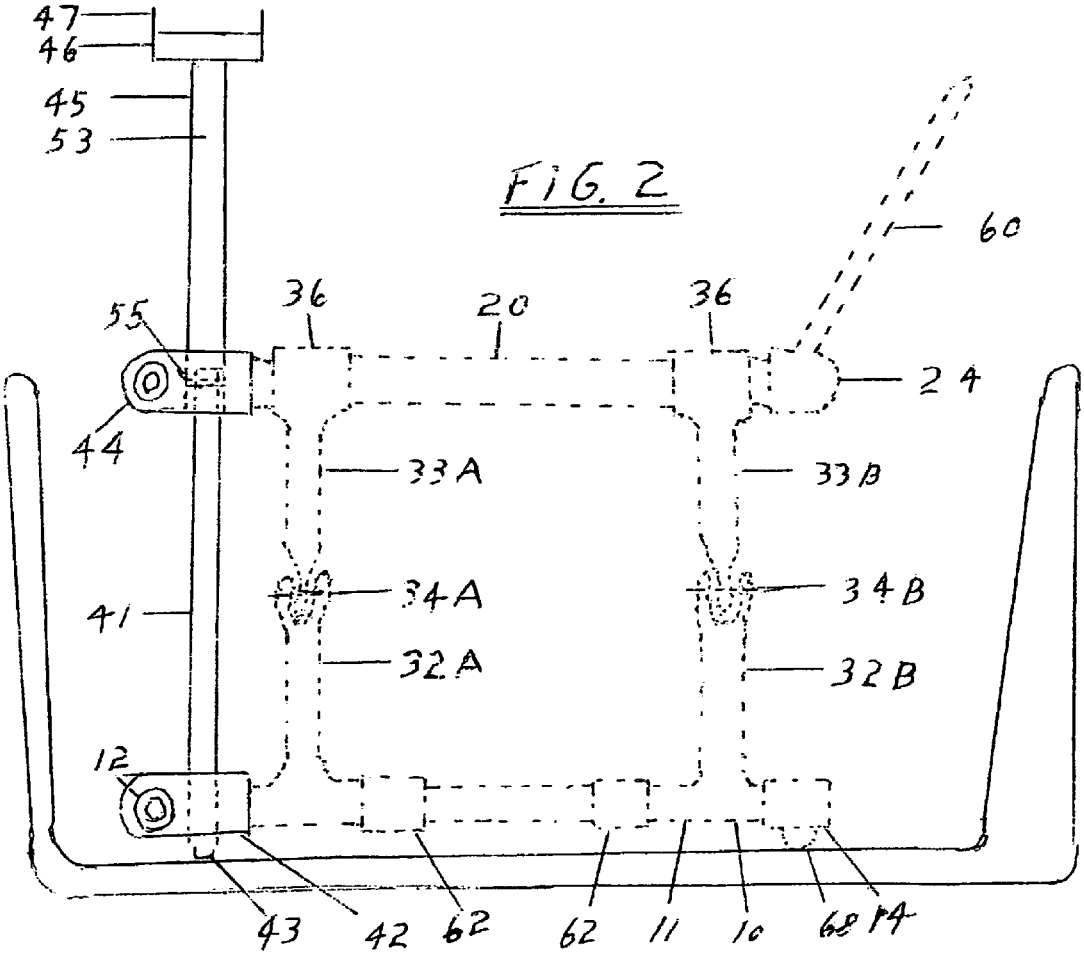
FIG. 2 is a side view of the device.
Figure 4:
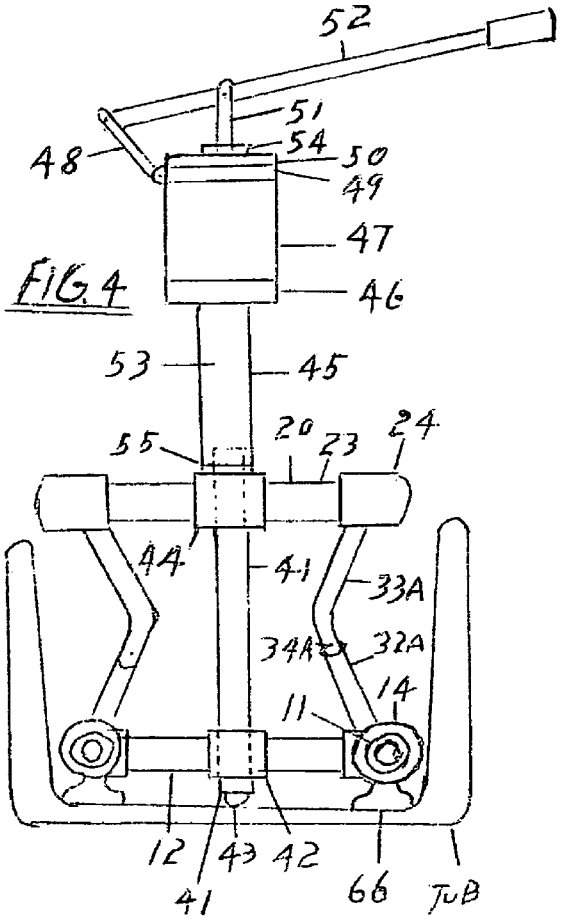
FIG. 4 is a similar view of the device with parts positioned for lowering the platform 20.
Figure 5:
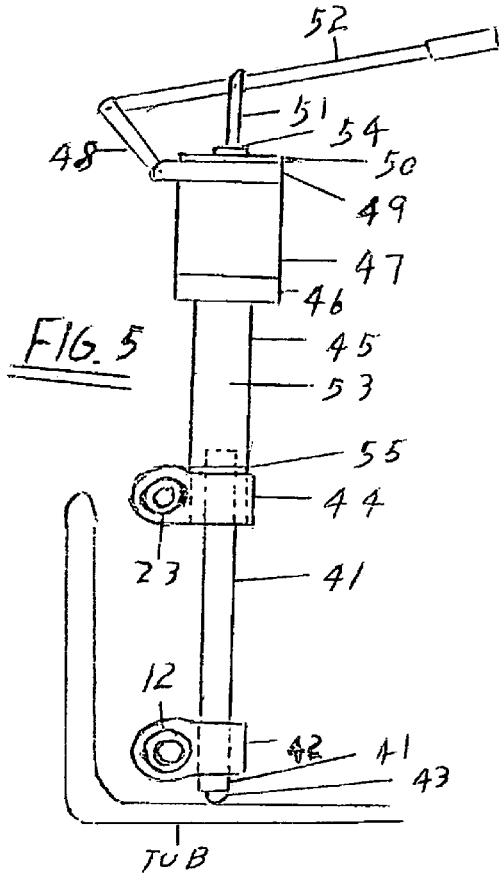
FIG. 5 is a fragmentary vertical section through the operating means of the individual assisting device

The horizontal rectangular base frame 10 is adapted to be formed of pipe, aluminum tubing or the like. The base frame 10 comprises parallel longitudinal rotating sides 11 which rotate in the operation of the device and which have two integral arms 32 A and 32 B extending at right angles to each as shown. The ends of sides 11 are held securely in place by parallel transverse members 12 and 15 arranged at right angles to the sides 11. The parallel transverse members 12 and 15 have T-fittings 14 with an inside bearing surface, affixed to each end. Rockshafts 11 have journals at the indicated locations so rockshafts 11 may freely rotate in the fittings 14 which are affixed to each end of base frame 10 members 12 and 15. The rockshafts 11 which also serve as the longitudinal members 11 of the base frame 10 have integral arms 32 A and 32 B arranged at right angles to the rockshafts 11 and arranged on the rockshafts 11 as shown in FIG. 1. The rectangular horizontal base frame 10 is considerably longer in the longitudinal direction than in the transverse direction. The base frame 10 constructed as above described is secure and stable.

The device further comprises a horizontal rectangular lifting platform 20. The platform 20 embodies a rigid rectangular frame including parallel longitudinal frame members 21 and parallel transverse frame members 22 and 23 arranged at right angles to the members 21. The members 21, 22 and 23 may be formed of pipe, aluminum tubing or the like. Corresponding ends of the longitudinal frame members 21 are rigidly connected with the transverse members 22 and 23 with right angle couplings 24 as shown. Platform 20 has two reinforcing transverse members 35 securely attached to members 21 by fittings 36. Floating arms 33A and 33B extend downwardly from each member 21. A rigid rectangular frame headrest 60 is provided on the device. Headrest 60 may be constructed of aluminum tubing or the like. Headrest 60 is the same width as platform 20 and is approximately 24 inches long. Headrest 60 is attached to elevating platform 20 transverse member 22 by means of adjustable fittings 61 as shown.

Elevating platform 20 will be covered with a light rigid aluminum or other suitable grill to support the weight of the user. A separate, suitable, porous, plastic, removable cover of the grill should be available for each user. Headrest 60 will be covered with a suitable plastic network.

Mechanical Operation of this Device

This individual assisting device for bathtubs is operated by Hydraulic jack 40 or other suitable means. Hydraulic jack 40 uses mineral oil or other as hydraulic fluid. Hydraulic jack 40 is attached securely to this device at two points. The lower point of attachment is to the base frame 10 transverse member 12 by special fitting 42 located on the center of transverse member 12. Special fitting 42 has an integral right angle fitting on its side through which jackshaft 41 is securely attached. Jackshaft 41 has a plastic or rubber bumper 43 attached on the lower end to bear pressure on the bottom of the bathtub. The upper point of attachment to this device by hydraulic jack 40 is to the elevating platform 20 end member 23 by special fitting 44 which is located on the center of end member 23 as shown. Special fitting 44 has an integral right angle fitting on its side through which jackshaft barrel 45 is securely attached. The lower end of jackshaft barrel 45 is set at the lower side of special fitting 44 and is fitted with a bushing through which jack shaft 41 can freely slide. The upper end of jackshaft 41 is fitted with a seal 55 which retains the oil under pressure in the chamber of jackshaft barrel 45 above jackshaft 41 and below valve body 46. Hydraulic jack 40 consists of; jackshaft 41, jackshaft barrel 45 and valve body 46 which contains the valves arranged for the proper operation of the jack 40. The jack 40 also consists of the reserve fluid tank 47 and rotating collar 49 which jack handle 52 fulcrum 48 is attached as shown. Jack handle 52 rotates freely and pivots around pump stem 51 by means of rotating collar 49 so that this device may be operated by the user or an attendant on either side.

Hydraulic jack 40 also consists of pump stem 51 which is the cylinder of the pump and the pump piston which is attached to the center of valve body 46. Jack 40 also consists of tank 47 cover 50. Cover 50 has a bushing 54 in the center through which pump stem 51 can freely slide.

The base frame 10 is comprised of the longitudinal side members 11 which rotate in the operation of the device. Members 11 have two right angle integral arms 32 A and 32 B that connect to integral offset fittings of floating arms 33 A and 33 B at points 34 A and 34 B as shown. Base frame 10 is held stable and secure by transverse members 12 and 15 which have integral right angle T-fittings 14 at each end as shown. The T-fittings 14 have inner bearing surfaces which allow rockshafts 11 to rotate freely on journals or races located on rockshafts 11. The transverse members 12 and 15 are located on the respective ends of longitudinal frame 10 members 11 or rockshafts 11 as shown. Base frame 10 also has two transverse reinforcing members 38 located close to integral arms 32A and 32 b as shown Members 38 have T fittings 62 on each end. T fittings 62 have inside bearing surfaces and allow rockshaft 11 to rotate freely on a journal or race located on member 11. A three inch suction cup 66 is affixed to the lower side of T-fittings 14 at each end of transverse member 12 to engage with the bottom of the tub. A one inch rubber or plastic bumper 68 is affixed to the lower side of T-fitting 14 at each end of transverse member 15 to rest on the bottom of the tub.

Means are provided for interconnecting the horizontal platform 20 and base frame 10 and for elevating and lowering the platform 20 relative to the base frame 10. Such means comprise: the base frame 10 longitudinal members 11 or rockshafts 11 with the integral right angle arms 32 A and 32 B. Arms 32 A and 32 B connect to an integral offset fitting of floating arms 33 A and 33 B at points 34 A and 34 B. The other or upper end of floating arms 33 A and 33 B have an integral T fitting 36 which has an inner bearing surface. Floating arms 33 A and 33 B rotate freely at journals or races located on longitudinal members 21 of elevating frame 20 as frame 20 is raised or lowered in the operation of this device.

Physical Operation of this Device

In the physical operation of this device we begin with elevating platform 20 at its lowest point. Jack handle 52 is easily moved up and down; on the down stroke, hydraulic oil from jack tank 47 is introduced under pressure through a check valve in valve body 46 into the chamber 53 of jackshaft barrel 45 above jackshaft 41, this causes jackshaft barrel to rise. As jackshaft barrel 45 rises, it raises the jack 40 or foot end of elevating platform 20. As platform 20 rises it lifts floating arms 33A and 33B and the offset flexible connections 34A and 34B in turn lift integral arms 32A and 32B. This rotates rockshafts 11. As rockshafts 11 rotate, upward pressure by integral arms 32A and 32B through offset flexible connections 34A and 34B in conjunction with floating arms 33A and 33B is exerted on the head end of platform 20. This action raises the head end of platform 20 in conjunction with the rising movement of the foot end of platform 20. Subsequent gentle down strokes of jack handle 52 raises platform 20 to the desired position at the top of the tub.

To return to the bottom of the tub, we gently press jack handle 52 to its lowest position. This opens a valve in valve body 46 which releases the oil in chamber 53 back into reservoir tank 47 and allows platform 20 to slowly descend.

In the Use of this Device

In the use of this device; with the device properly placed in the bathtub, with elevating platform 20 adjusted to the desired level at the top of the tub and the desired level of bathwater at the desired temperature in the tub, it is ready to be used. The user sits on elevating platform 20, turns with feet toward the jack or foot end of the device and relaxes in a prone position on the headrest end. Jack handle 52 can be adjusted for the convenient operation by the user or moved to either side to be operated by an assistant. Jack handle 52 is pressed gently down until it opens the valve in valve body 46 and allows platform 20 to slowly descend to the bottom of the tub, with the user. When the user desires to return to the top of the tub, the jack handle 52 is gently moved up and down and the elevating platform 20 slowly rises to the desired level with the user.

REFERENCES CITED IN THE FILE OF THIS APPLICATION
UNITED STATES PATENTS

| | | | | | |
|---|---|---|---|---|---|
| 7,506,385 | Werschmidt | 2009 | 4,091,478 | Hardwick | 1978 |
| 6,425,146 | O'Brien et al | 2002 | 3,958,282 | Crowe | 1976 |
| 5,937,454 | Drew | 1999 | 2,968,814 | Ashby | 1961 |
| 5,579,544 | Attler | 1996 | | | |
| 5,555,575 | Anscombe-Black | 1996 | | | |
| 5,377,366 | Boyd et al | 1995 | | | |
| 5,068,930 | Ruggiero | 1991 | | | |

| No. | Item |
|---|---|
| 10. | base frame |
| 11. | rotating longitudinal sides |
| 12. | transverse member |
| 14. | Integral T fittings |
| 15. | transverse member |
| 20. | elevating platform frame |
| 21. | longitudinal members |
| 22. | head end transverse member |
| 23. | foot end transverse member |
| 24. | right angle couplings |
| 32A. | foot end integral arms |
| 32B. | head end integral arms |
| 33A. | foot end floating arms |
| 33B. | head end floating arms |
| 34A. | foot end flexible connections |
| 34B. | head end flexible connections |
| 35. | reinforcing transverse members |
| 36. | integral T fittings |
| 38. | transverse reinforcing members |
| 40. | hydraulic jack |
| 41. | jack shaft |
| 42. | special fitting |
| 43. | bumper |
| 44. | special fitting |
| 45. | Jackshafbarrel |
| 46. | valve body |
| 47. | reservoir tank |
| 48. | fulcrum |
| 49. | rotating collar |
| 50. | tank cover |
| 51. | pump stem |
| 52. | jack handle |
| 53. | pressure chamber |
| 54. | bushing |
| 55. | pressure seal |
| 60. | head rest |
| 61. | adjustable fittings |
| 62. | integral T fittings |
| 66. | suction cups |
| 68. | bumpers |

I claim:

1. An individual assisting device to be removably mounted in bathtubs for lifting and lowering a user comprising, an elongated substantially horizontal base frame comprising transversely spaced rotatable longitudinal tubes and transverse elements connecting the ends of the tubes, the base frame being mounted upon and supported by the bottom of a bathtub, an individual supporting platform including a generally horizontal upper frame including spaced longitudinal frame members and transverse frame members connecting the ends of said spaced longitudinal frame members, said longitudinal tubes comprising two horizontal rockshafts and each having an integral arm extending therefrom at a right angle near each end of the respective tubes, each integral arm being pivotally connected at an upper end with a floating arm which is rotatably attached to said longitudinal frame member near each end thereof said connection being made to an offset fitting of said floating arm, a hydraulic jack for lowering and elevating said upper frame, said jack being connected between a transverse element of said base frame and a transverse frame member of said upper frame whereby, actuation of said jack will cause said longitudinal tubes to rotate, thereby causing said upper frame to move toward or away from said base frame in a vertical direction due to the interconnection of said respective frames by said integral arms and floating arms thus providing lifting and lowering of a user positioned upon said upper frame.

2. The device of claim 1 further comprising a headrest attached to an end of said upper frame opposite to that where said jack is connected.

3. The device of claim 1 further comprising a grill attached to said upper frame member for supporting a user.

* * * * *